US011631576B1

(12) United States Patent
Crichton

(10) Patent No.: US 11,631,576 B1
(45) Date of Patent: Apr. 18, 2023

(54) MASS SPECTROMETRY ION FUNNEL

(71) Applicant: Microsaic Systems PLC, Woking (GB)

(72) Inventor: Edward Crichton, Woking (GB)

(73) Assignee: Microsaic Systems PLC, Woking (GB)

( * ) Notice: Subject to any disclaimer, the term of this patent is extended or adjusted under 35 U.S.C. 154(b) by 0 days.

(21) Appl. No.: 17/925,374

(22) PCT Filed: May 28, 2021

(86) PCT No.: PCT/EP2021/064356
§ 371 (c)(1),
(2) Date: Nov. 15, 2022

(87) PCT Pub. No.: WO2021/249790
PCT Pub. Date: Dec. 16, 2021

(30) Foreign Application Priority Data

Jun. 9, 2020 (GB) ..... 2008720

(51) Int. Cl.
*H01J 49/06* (2006.01)

(52) U.S. Cl.
CPC ..... *H01J 49/066* (2013.01)

(58) Field of Classification Search
CPC ..... H01J 49/066
USPC ..... 250/281, 282, 283
See application file for complete search history.

(56) References Cited

U.S. PATENT DOCUMENTS

2005/0006579 A1 1/2005 Franzen
2013/0175441 A1 7/2013 Zanon et al.
2013/0207000 A1 8/2013 Günther et al.
2014/0339414 A1 11/2014 Loboda
2015/0233866 A1* 8/2015 Verenchikov ..... H01J 49/06 250/282
2015/0357174 A1 12/2015 Ibrahim et al.
2018/0277350 A1* 9/2018 Jarrold ..... H01J 49/0031
2019/0189393 A1 6/2019 Ibrahim et al.
2022/0059319 A1* 2/2022 Bennahmias ..... H01J 37/3007

FOREIGN PATENT DOCUMENTS

WO WO9749111 12/1997

OTHER PUBLICATIONS

Schlottmann, Florian et al., "A Simple Printed Circuit Board-Based Ion Funnel for Focusing Low Ratio Ions with High Kinetic Energies at Elevated Pressure," Journal of the American Society for Mass Spectrometry, Elsevier Science Inc., US, vol. 30, No. 9, May 28, 2019, pp. 1813-1823.
Ian K. Webb et al., "Experimental Evaluation and Optimization of Structures for Lossless Ion Manipulations for Ion Mobility Spectrometry with Time-of-Flight Mass Spectrometry," Analytical Chemistry, vol. 86, No. 18, Sep. 16, 2014, pp. 9169-9176.
ISR/WO from PCT/EP2021/064356.

* cited by examiner

*Primary Examiner* — Nicole M Ippolito
(74) *Attorney, Agent, or Firm* — Stephen T. Scherrer; Monique A. Momeault; Scherrer Patent & Trademark Law, P C.

(57) ABSTRACT

An ion funnel fabricated from at least three faces that are each formed from a printed circuit board is described. In one aspect the faces are arranged edge to edge and there is provided a set of guard rails proximal to the edges to bias ions away from the edges. In another aspect slots are provided within the circuit board to facilitate an escape of gases from within the funnel.

13 Claims, 9 Drawing Sheets

MASS SPECTROMETRY ION FUNNEL

FIELD

The present teaching relates to mass spectrometry and in particular to ion funnels that are used in mass spectrometry to direct and focus a beam of ions from an ionization source into a mass spectrometer detector.

BACKGROUND

Ion funnels are typically constructed from a stack of plate electrodes (typically 30-100) with decreasing apertures. RF potentials of opposite polarity are applied on adjacent electrodes to create an effective potential—sometimes referred to as a pseudopotential—that radially confines the ions passing through the ion funnel. As successive electrodes have decreasing apertures, the net result is that a spatially dispersed ion cloud entering the ion funnel is efficiently focused to a much smaller radial size on exiting the ion funnel.

Each of the individual plate electrodes needs to be supplied with individual DC with alternating RF voltages superimposed. The result is there is a complicated kit of parts which need to be assembled with precision in a particular order. Ion funnels can also benefit from a fine pitch of electrodes—something which can be difficult to achieve with conventional ion optics. It will be appreciated that this may require a separate distribution circuit board, typically printed circuit board (PCB), which develops the necessary voltages. The electrode set either has to be connected via a complex wiring network or integrated to the PCB and soldered directly. The physical size of the sockets or solder pads ultimately limits electrode pitch and this can affect the practical application of these type of devices.

Recently there have been developments in the design of ion funnels including the use of printed circuit boards (PCBs). Schlottmann, F., Allers, M., Kirk, A. T. et al. A Simple Printed Circuit Board-Based Ion Funnel for Focusing Low m/z Ratio Ions with High Kinetic Energies at Elevated Pressure. *J. Am. Soc. Mass Spectrom.* 30, 1813-1823 (2019) discuss the construction of a funnel by bringing together a set of four wedge shaped PCBs to produce a square pyramidal analogue of an ion funnel with the electrodes replaced with tracks. This ultimately defines an asymmetric arrangement which can be complex to assemble whilst ensuring that the functionality of the ion funnel is achieved. Whilst this evidently benefits from use of PCB technology in providing the electrodes the fabricated funnel bridges two chambers and its solid construction means that gas cannot escape radially (as is typical of stacked plate ion funnels). This increase the gas load downstream chambers and has the potential for gas flow at the exit to interfere with ion motion in the region of the exit. Furthermore, as the device is constructed in two halves by soldering a daughter board and then bringing halves together before fixing with adhesive, there is a requirement for a skilled operator—it is very much a manual operation and therefore whilst theoretically advantageous it would appear that it is incompatible at least in part with high volume PCB fabrication techniques. The design also suffers in that it introduces a gap in the tracks where the two halves meet which has the potential for ion loss unless gaps are similar to the track spacing further increasing the dependence on precision/tolerancing in construction.

Accordingly, there is a need to provide a ion funnel that can address these and other constraints of conventional ion funnels.

SUMMARY

Accordingly there is provided an ion funnel comprising a plurality of faces, each being formed from a printed circuit board, and arranged relative to one another to form a pyramidal structure having a base and an apex, an entrance to the ion funnel being defined at the base of the pyramidal structure and an exit from the ion funnel being defined at the apex of the pyramidal structure, the funnel being configured to define an ion path within the pyramidal structure between the entrance and the exit, each of the plurality of faces having a plurality of separate and distinct electrode tracks defined on a respective inner surface, the plurality of electrode tracks being arranged substantially transverse to the ion path and extending from the base to the apex, adjacent electrode tracks being operatively coupled to both RF and DC voltages to effect RF ion confinement to focus and direct an ion beam towards the exit of the funnel.

The plurality of faces are desirably each formed having a truncated triangular geometry and are desirably arranged edge to edge with one another to define an enclosed volume within which the ion beam will operatively travel.

The plurality of faces are preferably arranged relative to one another such that each of the electrode tracks on a first face has a corresponding electrode track on a second face.

The plurality of electrode tracks on each face are desirably separate and distinct from the plurality of electrode tracks on the other faces, each track extending across the inner surface of its respective surface from a first edge to a second edge.

Each of the electrode tracks are optimally substantially parallel with one another.

Each of the faces preferably has a plurality of slots defined in, and extending through, the printed circuit board, the slots being provided between adjacent tracks, and operatively providing an outlet through which a gas may vent through the faces of the funnel.

The funnel optimally further comprises a plurality of guard rails provided at the edges of the faces, the guard rails being configured to operatively bias ions away from the edges of the faces, the guard rails extending from the base to the apex of the pyramidal structure. The guard rails are desirably provided at a higher DC voltage than the electrode tracks.

The funnel may further comprise bias rails co-located with fixtures provided within the funnel, the bias rails being provide at an elevated DC voltage to the electrode tracks and operatively biasing ions away from the fixtures.

Desirably each of the faces have edges that are proximal to, but not fixed to or against, edges of a neighbouring face.

These and other aspects and features will be better understood with reference to the drawings that now follow.

BRIEF DESCRIPTION OF THE DRAWINGS

FIG. 3A shows an arrangement with no guard rails, FIG. 3B shows an arrangement with guard rails that are provided out of phase and FIG. 3C shows an arrangement with guard rails that are provided in phase

FIG. 8A shows no ions present within the funnel, FIG. 8B shows simulated ion trajectories in the presence of a grounded fixture and FIG. 8C shows simulated ion trajectories in the presence of a biased fixture inside the funnel.

DETAILED DESCRIPTION OF THE DRAWINGS

FIG. 1 shows two examples of an ion funnel 100 comprising a plurality of faces 105 in accordance with the present teaching. In the example of FIGS. 1A and 1B, the ion funnel is formed from three faces, whereas in FIGS. 1C and 1D, the ion funnel is formed from five faces. In each example, the individual faces are each formed from a printed circuit board and arranged relative to one another such that the ion funnel has a pyramidal structure having a base 110 and an apex 120. These exemplary arrangements are fabricated from printed circuit boards, PCBs, that each have a truncated triangular geometrical form. It will be appreciated that this geometry is particularly advantageous in that it facilitates a stacking of the faces edge to edge to form the pyramidal structure defining the ion funnel.

An entrance 110A to the ion funnel is defined at the base 110 of the ion funnel 100 and an exit 120A from the ion funnel is defined at the apex 120 of the pyramidal structure. It will be appreciated that as the exit 120A is formed from an aperture defined at the apex that the pyramidal structure is effectively a truncated pyramid as the individual triangular faces 105 do not meet physically to form an actual point.

The funnel is configured to define an ion path within the internal volume of the pyramidal between the entrance 110A and the exit 120A. The ion path extends from the entrance 110A to the exit 120A. A spatially dispersed ion cloud entering the ion funnel at the entrance 110A travelling along the ion path is efficiently focused to a much smaller radial size on exiting the ion funnel's exit 120A.

Figure 5:
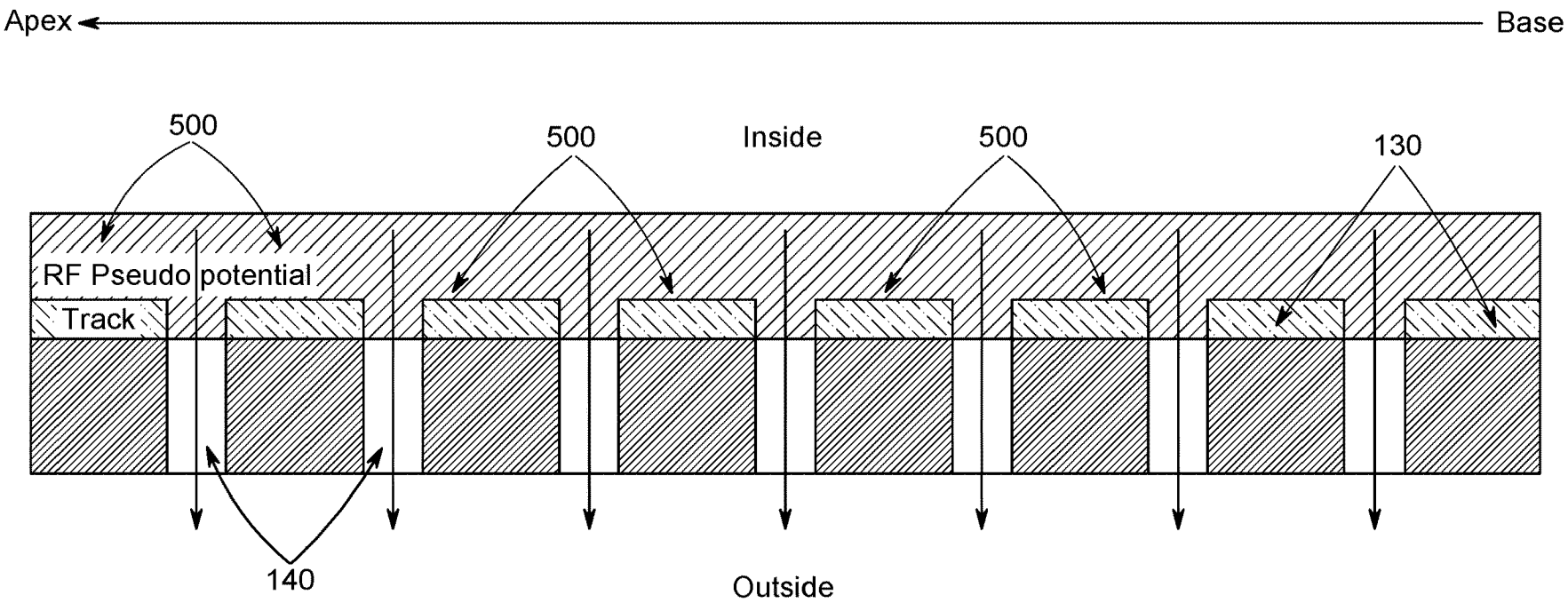
FIG. 5 is a side view sectional schematic of portion of a triangular face in accordance with another aspect of the present teaching.
Figure 6A:
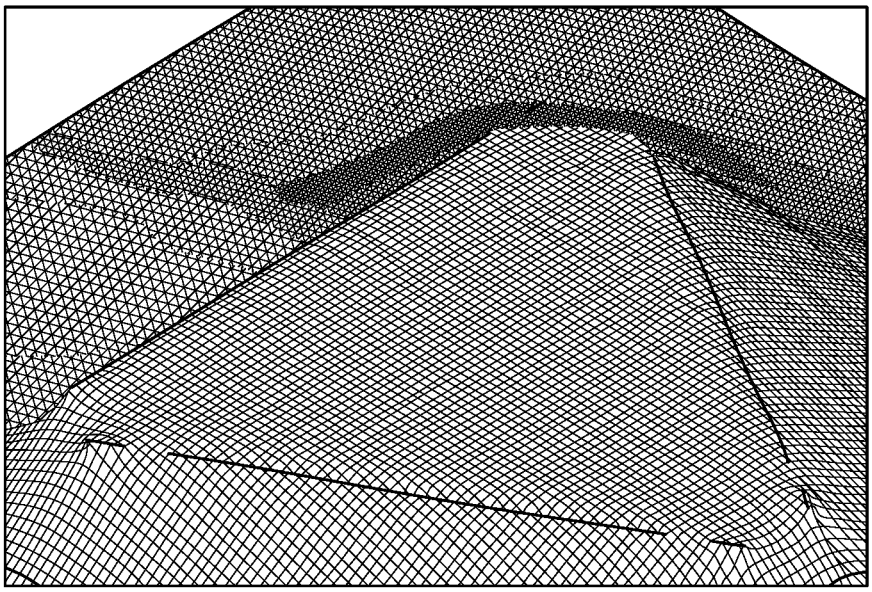
FIGS. 6A and 6B are two electrostatic potential simulation schematics showing the effect of the guard rails being off (6A) and on (6B).
Figure 6B:
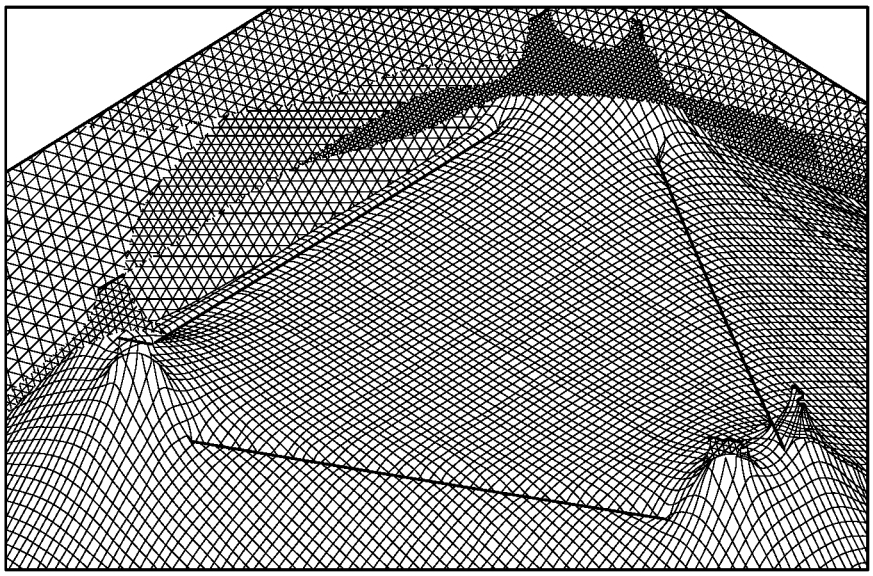

This focusing is effected by the provision of a plurality of separate and distinct electrode tracks 130 defined on each of the respective inner surfaces 140 of the plurality of triangular faces. The plurality of electrode tracks 130 are arranged substantially transverse to the ion path and extending from the base to the apex. Similarly to the operation of known ion funnels, adjacent electrode tracks are operatively coupled to both RF and DC voltages to effect RF ion confinement to focus and direct an ion beam towards the exit of the funnel. As is visualised in FIG. 5, this is effected by the generation of an RF pseudo potential 500 in the region proximate to the individual tracks 130

As is evident from FIG. 1 but also in the simulation results of FIG. 7, the plurality of triangular faces 105 are desirably arranged edge to edge with one another to define the enclosed inner volume 140 within which the ion beam 700 will operatively travel. Whilst they are separate and distinct, the plurality of triangular faces are preferably arranged relative to one another such that each of the electrode tracks on a first triangular face has a corresponding electrode track on a second triangular face.

Figures 3A, 3B, 3C:
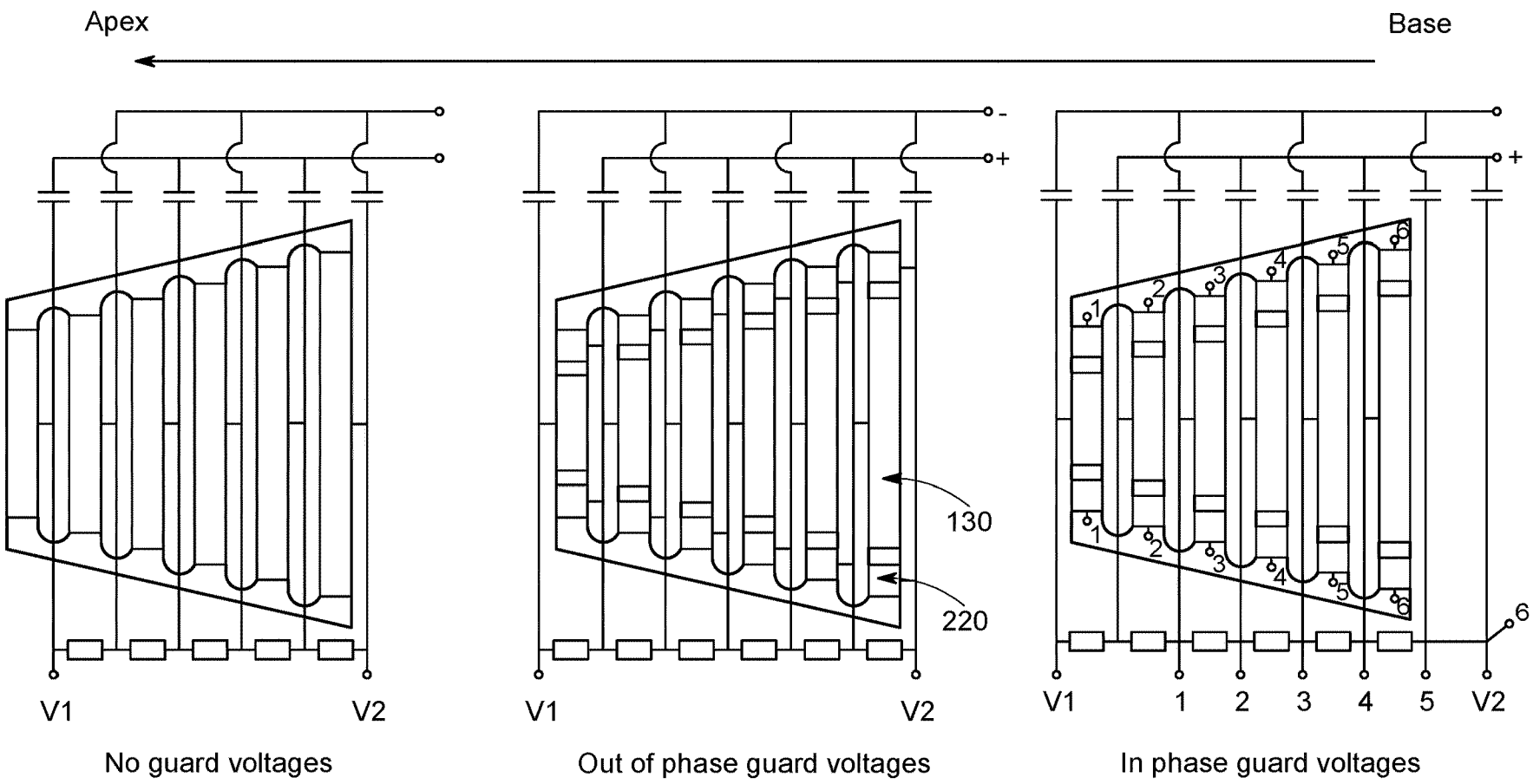
FIGS. 3A, 3B, and 3C show respectively, schematics of the electronic circuitry that can be used to drive electrical components of triangular faces of a funnel in accordance with the present teaching.

As is visible in each of FIGS. 1, 3, and 7, the plurality of electrode tracks 130 on each face are desirably separate and distinct from the plurality of electrode tracks on the other faces. Each track 130 extends across the inner surface of its respective triangular surface from a first edge region 205 to a second edge region 210. The edge region may not actually be at the side 215 of the face. Each of the electrode tracks are optimally substantially parallel with one another and extend substantially transverse to the direction of travel of the ion beam from the entrance to the exit of the funnel. The electrode tracks can be fabricated using conventional PCB manufacturing techniques.

In addition to the electrode tracks, each of the triangular faces preferably has a plurality of slots 150 defined in, and extending through, the substrate defined by the printed circuit board. The slots 150 are provided between adjacent tracks 130, and operatively provide an outlet through which a gas may vent through the faces of the funnel. By providing the slots 150 cut between the tracks, which may be effected using for example in this instance using the standard PCB fabrication techniques. This allows the funnel to vent gas radially which is an advantage over prior art funnels which do not have this capacity with the result that there is an increased gas load on the downstream side of the ion beam. It will be appreciated however that it may be however beneficial in some circumstances to not include these perforations in order to maximise track density by increasing the maximum tolerable space charge.

Figure 1A:
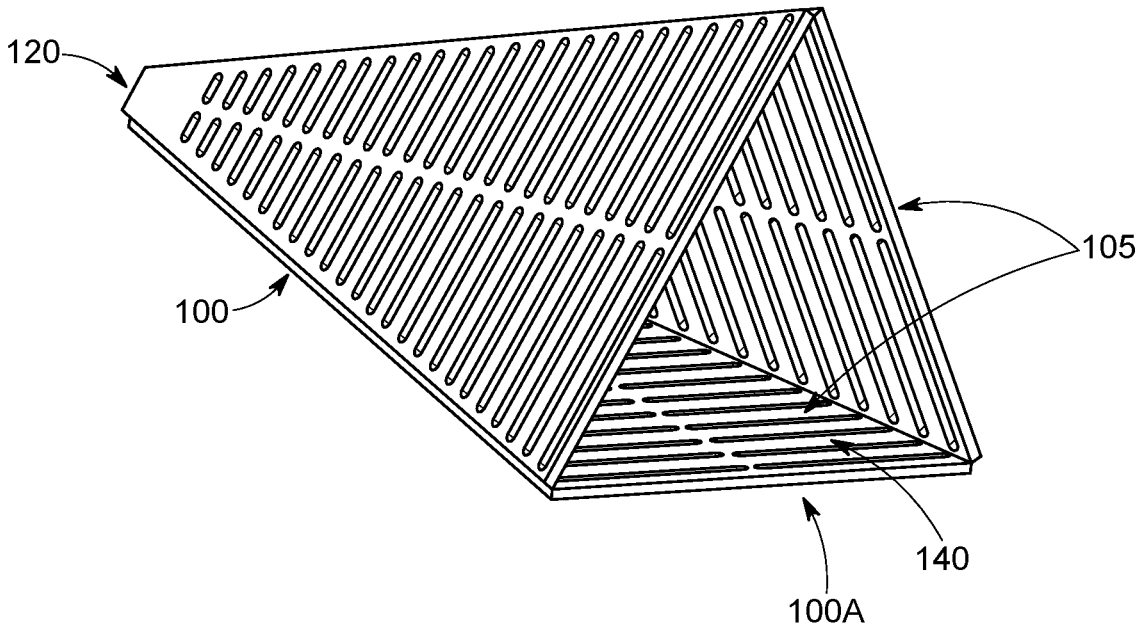
FIG. 1A and FIG. 1B show, respectively, perspective views from the base and the apex of a three-sided ion funnel in accordance with the present teaching
Figure 1B:
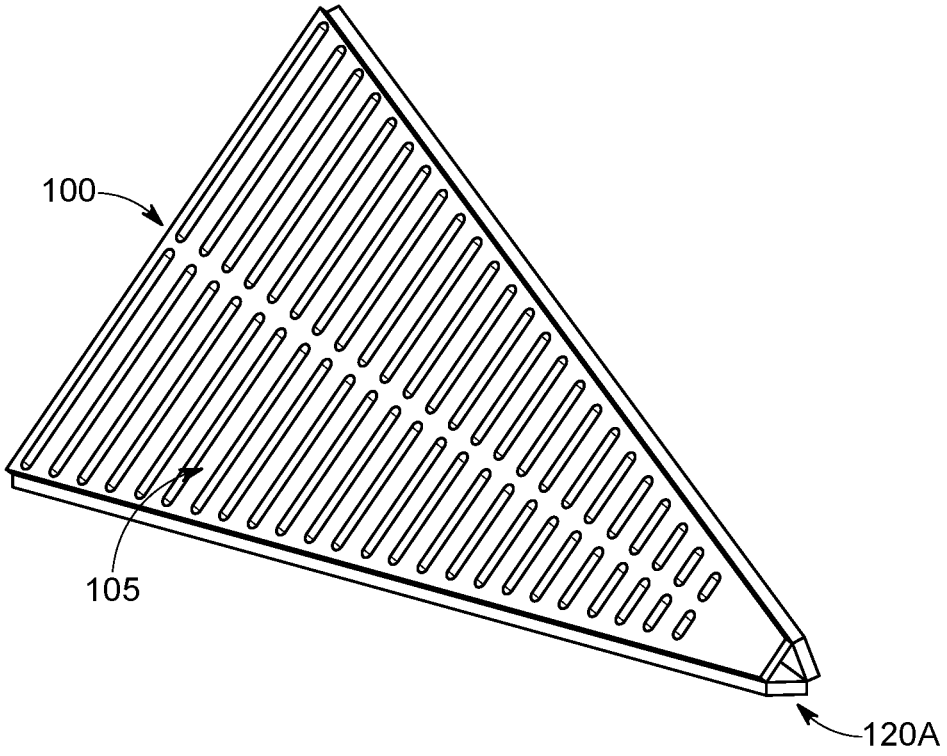
Figure 1C:
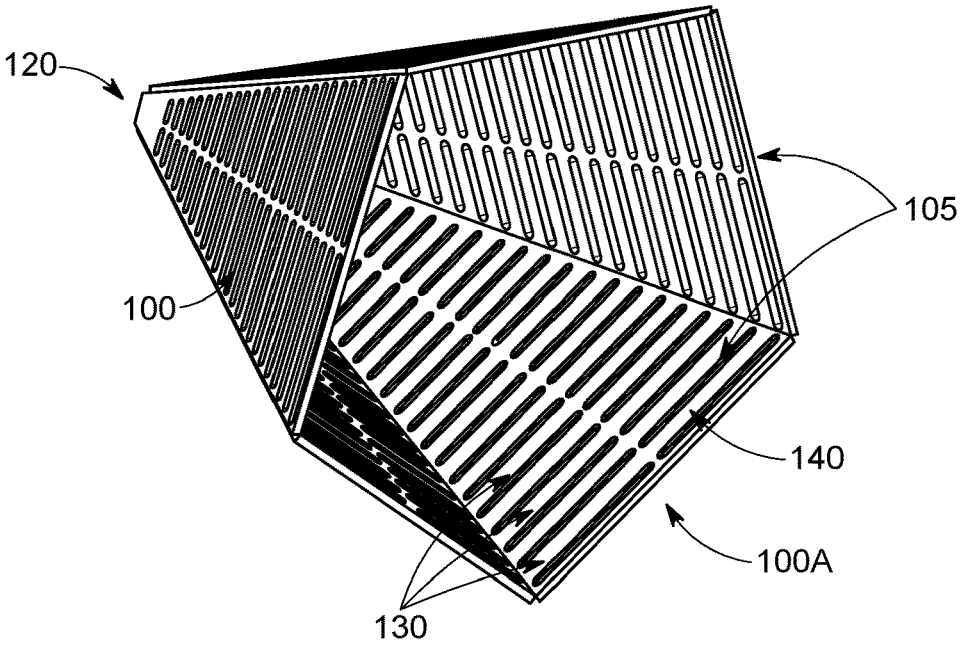
FIG. 1C and FIG. 1D show, respectively, perspective views from the base and the apex of a five-sided ion funnel in accordance with the present teaching
Figure 1D:
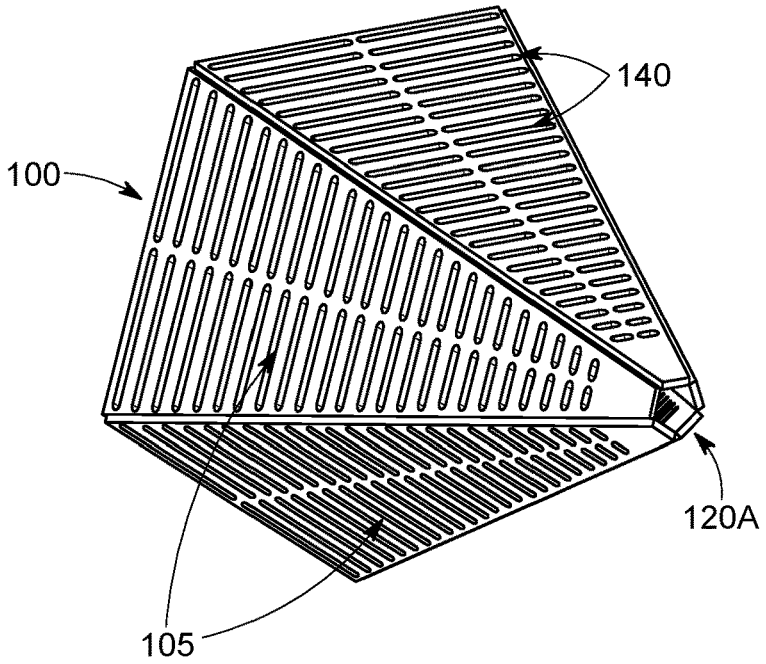
Figure 2:
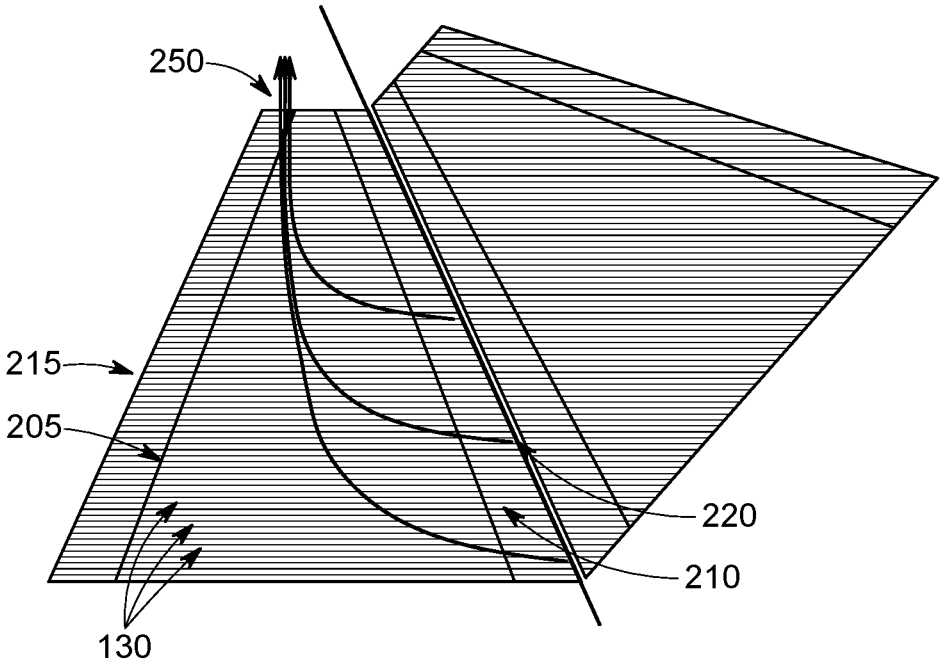
FIG. 2 shows in schematic form two triangular faces in a non-assembled state outlining the operation of a guard rail in accordance with the present teaching

As is visible in FIGS. 2 and 3 the funnel optimally further comprises a plurality of guard rails 220 provided at the edges 215 of the triangular faces. Desirably each of the faces have edges that are proximal to, but not fixed to or against, edges of a neighbouring face. The guard rails 220 are configured to operatively bias ions 250 away from the edges of the triangular faces, evident from the schematic of FIG. 2. The guard rails extending from the base to the apex of the pyramidal structure. The guard rails are desirably provided at a higher DC voltage than the electrode tracks.

Figure 7A:
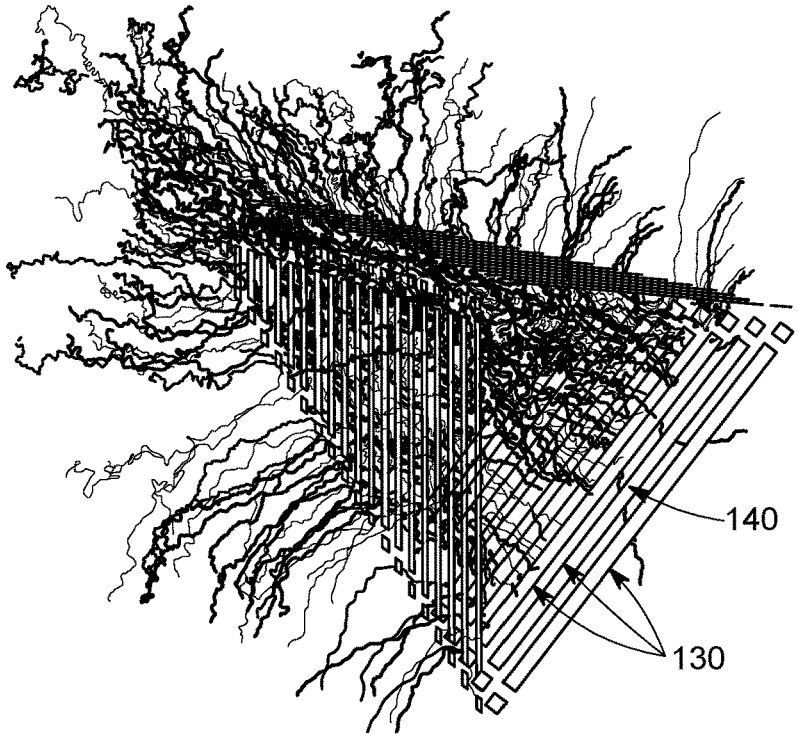
FIGS. 7A and 7B are two ion trajectory simulation schematics showing the effect of the guard rails being off (7A) and on (7B).
Figure 7B:
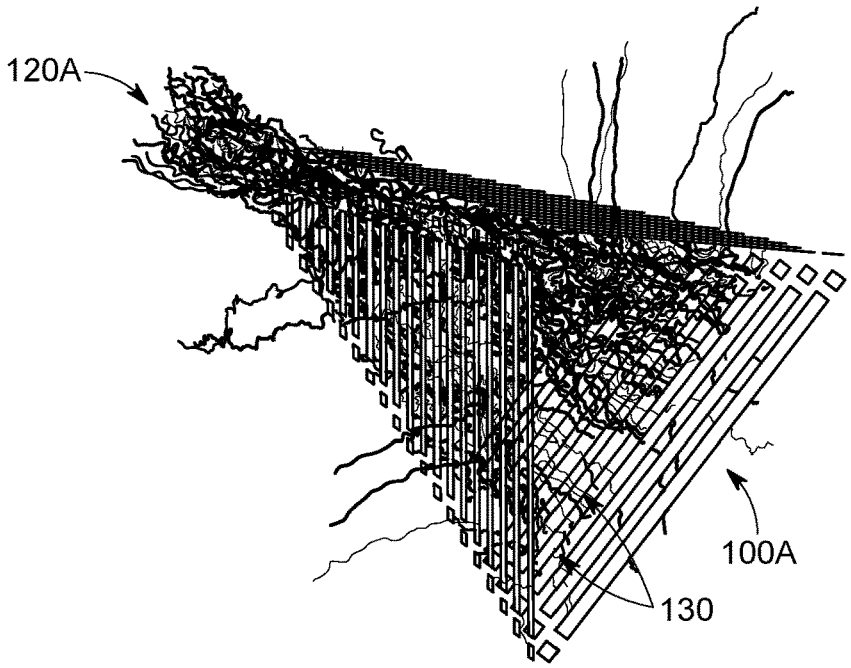

It will be appreciated that ion funnels produced with planar walls tend to concentrate ions up into their corners. This is a natural consequence of the isotropic nature of ion diffusion in the plane perpendicular to device axis and the non-isotropic closing in of the funnel 'walls' as it is traversed. The present inventor has identified that the junctions in PCB ion funnels are therefore critical regions. By placing a set of guard rails or tracks at an elevated DC potential, ions near the edge of the board can be prevented from reaching the corners of the device—the corners being the region between two adjacent triangular faces. This reduces the criticality of the construction of the junctions between PCBs. FIG. 7A and FIG. 7B show the effect in simulation in having the guard rails off (FIG. 7A) and having the guard rails on (FIG. 7B). simulation results demonstrate that having the guard rails on increases the transmission of ions through the funnel from 30% to about 85%, without requiring individual ones of the triangular faces being brought into contact. In the example of FIG. 7, the simulation was effected with the gap between adjacent triangular faces being twice the separation between the electrode tracks on each face. It will be appreciated that this demonstrates that a funnel can be fabricated without the need to bond or otherwise join the individual PCB boards that form the triangular faces. Without the need to solder the boards together they can individually be produced with the normal mass production techniques (e.g. solder re-flow). The guard rails are DC biased and may also in certain configurations be also coupled to an RF source.

Figure 4:
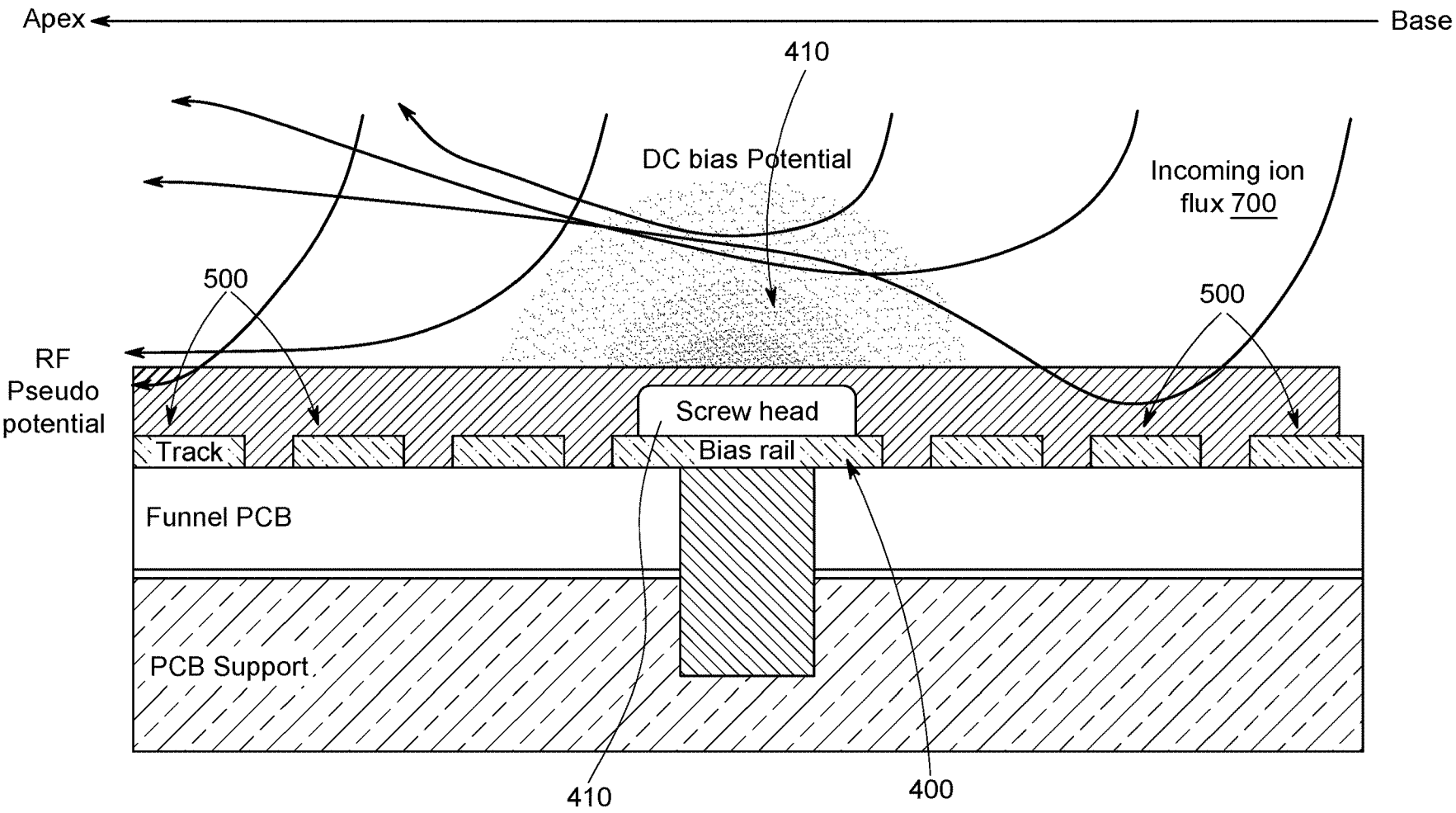
FIG. 4 is a side view sectional schematic of portion of a triangular face in accordance with one aspect of the present teaching.

As is shown in FIGS. 4 and 8 the funnel may further comprise bias rails 400 co-located with fixtures such as screw heads provided within the funnel. The bias rails 400 are provided at an elevated DC voltage to the electrode tracks and operatively biasing ions away from the fixtures by generating a DC bias potential 420. Ions within the ion flux 700 passing through the funnel are operatively biased away from each of the tracks 50 and the bias rails 400 so as to adopt a path that is generally about a main axis of the pyramidal structure.

Figures 8A, 8B, 8C:
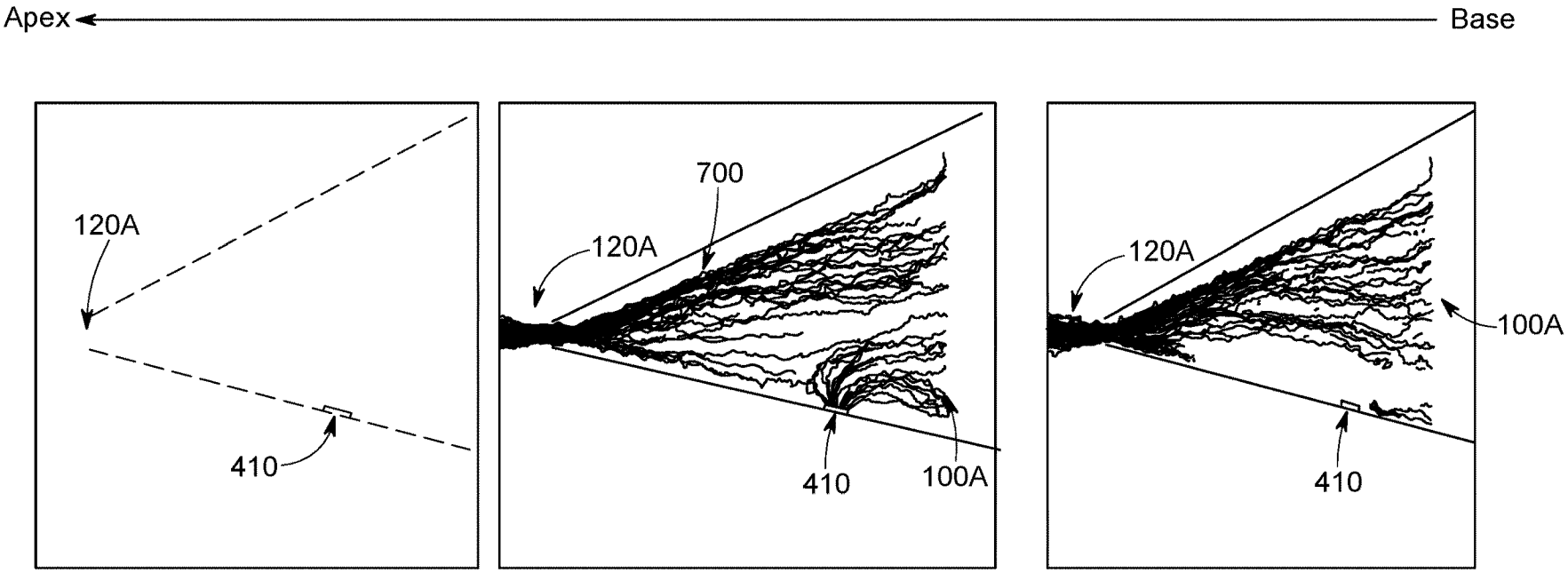
FIGS. 8A, 8B and 8C are schematics showing a cross-section in a plane containing a centreline of an ion funnel in accordance with the present teaching.

Such an arrangement is particularly advantageous in that it facilitates use of an ion funnel per the present teaching with other external hardware. The use of these bias rails with elevated DC can be used to discourage the ions away from fixtures (such as the mentioned screws). This means fixtures can be even be placed within the ion funnel volume. In the absence of these DC bias rails these fixtures would either charge up uncontrollably pinching off ion transmission or—if grounded—extract ions from the funnel reducing signal. FIG. 8 shows simulated ion trajectories showing a fixture 400 biased even as high as the inlet potential prevents ion loss on an internal fixture. It should be noted that this is a cut though which only shows loses in a narrow band for clarity—ions would be pulled in from all directions. The potential should be at a level higher than a potential of local electrodes but there is a significant range of tuning available. This could be fixed by direct connection to another electrical component of fixture. Certain configurations could provide these as tuneable potentials to facilitate changes dependent on location of the fixture and/or the type of mass spectra being analysed. FIG. 8B) shows how a grounded fixture would attract and ultimately discharge ions and therefore presents an alternative exit away from the desired route through the funnel. FIG. 8C) shows ion that a fixture can be incorporated provided it is biased above the ambient DC potential. Some ion trajectories appear to terminate on the 'upstream' side of the fixture but these are in fact diverted round the obstacle in directions outside the viewing plane. In the case of these simulations a potential equal to the funnel's input DC can be used without pinching off ion flow.

This can be realised by fixing the external end into an insulated insert and supplying DC potential to the head with a specific track for instance via plating through hole from the outside.

It will be appreciated that the embodiments disclosed herein reference 3 and 5 sides pyramidal structures. It will be appreciated that per the present teaching three faces, which are typically provided with a truncated triangular geometry, is the minimum number of surfaces required to obtain an enclosed funnel volume necessary for ion enrichment but the present teaching does not need to be considered limited to these 3 and 5 surface configurations. It will be understood that exemplary embodiments of an ion funnel in accordance with the present teaching have been described. The present inventor has identified that it is possible to fabricate an ion guide with at least three sides, each of the sides preferably having a wedge shaped or triangular configuration and being individually planar in form. When assembled relative to one another none of the planar sides are parallel with others of the planar sides such that the multiple sides cooperate with one another to adopt a funnel geometry having multiple planar surface which abut one another at respective edges. By providing tracks on each of the multiple PCBs, it is possible operatively apply a voltage to those tracks to constrain the passage of ions that are moving through the funnel. This reduces the number of components and complexity compared to a stacked ring/stacked PCB device.

Modifications can be made to these exemplary embodiments without departing from the scope of the present teaching which is to be considered limited only insofar as is necessary in the light of the claims that follow.

The invention claimed is:

1. An ion funnel comprising a plurality of individual faces, each face being formed from a printed circuit board, the faces being arranged edge to edge relative to one another to form a pyramidal structure having a base and an apex, an entrance to the ion funnel being defined at the base of the pyramidal structure and an exit from the ion funnel being defined at the apex of the pyramidal structure, the funnel being configured to define an ion path within the pyramidal structure between the entrance and the exit, each of the plurality of faces having a plurality of separate and distinct electrode tracks defined on a respective inner surface, the plurality of electrode tracks being arranged substantially transverse to the ion path and extending from the base to the apex, and wherein adjacent electrode tracks are operatively coupled to both radio frequency, RF, and DC voltages to effect RF ion confinement to focus and direct an ion beam towards the exit of the funnel, and wherein the funnel further comprises DC biased guard rails provided at the edges of each of the faces, the guard rails being configured to operatively bias ions away from the edges of the faces, the guard rails extending from the base to the apex of the pyramidal structure.

2. The funnel of claim 1 wherein the plurality of faces are arranged edge to edge with one another to define an enclosed volume within which the ion beam will operatively travel.

3. The funnel of claim 1 wherein the plurality of faces are arranged relative to one another such that each of the electrode tracks on a first truncated triangular face has a corresponding electrode track on a second truncated triangular face.

4. The funnel of claim 1 wherein the plurality of electrode tracks on each face are separate and distinct from the plurality of electrode tracks on the other faces, each track extending across the inner surface of its respective face from a first edge to a second edge.

5. The funnel of claim 1 wherein each of the electrode tracks are parallel with one another.

6. The funnel of claim 1 wherein each of the faces has a plurality of slots defined in, and extending through, the printed circuit board, the slots being provided between adjacent tracks, and operatively provide an outlet through which a gas may vent through the faces of the funnel.

7. The funnel of claim 1 wherein the guard rails are provided at a higher DC voltage than the electrode tracks.

8. The funnel of claim 1 further comprising bias rails co-located with fixtures provided within the funnel, the bias rails being provided at an elevated DC voltage to the electrode tracks and operatively biasing ions away from the fixtures.

9. The funnel of claim 1 wherein each of the faces have edges that are proximal to, but not fixed to or against, edges of a neighboring face.

10. The funnel of claim 1 wherein the guard rails are operatively coupled to an RF source, such that both RF and DC voltages are applied to the guard rails.

11. The funnel of claim 1 wherein the guard rails have DC voltages only applied thereto.

12. The funnel of claim 1 wherein at least a subset of the faces have a truncated triangular geometry.

13. The funnel of claim 12 wherein each of the faces have a truncated triangular geometry.

* * * * *